United States Patent [19]

Scott et al.

[11] 4,328,644

[45] May 11, 1982

[54] PLASTIC CLAD WINDOW AND METHOD OF MANUFACTURE

[75] Inventors: Roger P. Scott; W. Wayne Kahle, both of McConnelsville, Ohio

[73] Assignee: Philips Industries, Inc., Dayton, Ohio

[21] Appl. No.: 101,925

[22] Filed: Dec. 10, 1979

[51] Int. Cl.[3] ..... E06B 3/00

[52] U.S. Cl. ..... 49/501; 49/504; 52/727; 52/730

[58] Field of Search ..... 49/401, 501, 504, 507; 52/211, 309.15, 309.16, 727, 730

[56] References Cited

U.S. PATENT DOCUMENTS

| | | | |
|---|---|---|---|
| 2,760,242 | 8/1956 | Korb | 49/507 X |
| 3,072,229 | 1/1963 | Pasche et al. | 49/401 |
| 3,220,062 | 11/1965 | Hermann | 49/401 X |
| 3,340,665 | 9/1967 | Kohl | 52/727 X |
| 3,393,471 | 7/1968 | Skowland et al. | 49/504 X |
| 3,694,961 | 10/1972 | Johnson | 49/505 X |
| 3,815,285 | 6/1974 | Kuyper | 49/501 |
| 3,975,881 | 8/1976 | Ninowski, Jr. | 49/501 X |
| 4,084,361 | 4/1978 | Aspaas | 49/501 X |
| 4,207,707 | 6/1980 | Holdiman | 49/501 |

*Primary Examiner*—Kenneth Downey

*Attorney, Agent, or Firm*—Biebel, French & Nauman

[57] ABSTRACT

A casement type window is composed of a frame and sash which are independently made, each comprising a unitary prefabricated synthetic plastic shell having bonded therein a wooden frame which faces interiorly of the building wherein the window is mounted. Synthetic plastic elements of the frame or sash are accurately associated and brought together under pressure at mitered corner abutment joints which are heat fused to form an integral self supporting member before being united with their wooden frame components.

12 Claims, 10 Drawing Figures

PLASTIC CLAD WINDOW AND METHOD OF MANUFACTURE

BACKGROUND OF THE INVENTION

This invention relates to windows for building structures generally, and particularly to windows presenting weather-impervious external surfaces and methods of manufacturing them.

The problem of providing weather resistant windows has long been appreciated. Early conventional all wood frames and sashes were provided with some protection by proper painting, but still tended to deteriorate due to rain, snow and sun exposure. All-metal frames and sashes have been proposed and are in use, as are all-plastic windows wherein the frame and sash are composed of extruded shapes. These windows of all metal and plastic elements have been satisfactory to some degree, but are relatively expensive and present fabrication problems.

It has also been proposed to clad wooden frame and/or sash elements with lengths of extruded metal or plastic, and various examples are disclosed in U.S. Pat. Nos. to Strawther 2,753,603; Spencer 3,443,345; Sitterly 3,662,494; Elsenberg 3,667,179 and Kuyper 3,815,285. The present invention provides improvements over both the window assemblies and the methods of manufacture disclosed in those patents.

SUMMARY OF THE INVENTION

In the practice of the invention, the same procedure is followed in fabricating both the frame subassembly and the sash subassembly. Each includes a rectangular annular plastic shell designed to cover all parts of the associated wooden frame which would otherwise be exposed to the weather on the outside of the building wall wherein the window assembly is installed. In addition, the wooden frame associated with each shell is similarly of rectangular annular form complementary to its associated plastic shell and has its forward portion enclosed within the shell while its rearward portion is exposed toward the space inside the building wall and can be finished with paint or in any other manner suitable for bare wood.

The plastic shell components of both the frame subassembly and the sash subassembly are separately formed from four straight pieces of extruded plastic which are accurately cut to length with mitered ends, and then welded together by heat and pressure at the resulting miter joints to form a unitary shell having a continuous annular channel on its side which will face the interior of the room in installed position. The complementary wood frame for each subassembly is then built up within the shell, from initially separate straight pieces which are bonded to the shell and then nailed or otherwise fastened together adjacent the corners of the shell to complete the rectangular frame.

In addition to this broad outline of its principles, the invention provides a variety of specific advantageous features of both construction and method of fabrication of the frame and sash subassemblies which are more easily pointed out in the course of the description hereinafter of preferred embodiments, including, as a non-exclusive list, novel weather strip devices which operate in tandem to seal a movable sash in its closed position in the frame, novel extruded plastic shapes for the frame and sash which provide maximum strength and protection for the wood components of the window, and especially a novel method for fabricating the plastic frame and sash shells from initially straight pieces of extruded synthetic plastic which assures accurate dimensions and rectangular shape in the finished subassemblies.

The product of the invention, in its preferred embodiments, is a complete window assembly which provides all the advantages of wood in both the frame and sash, including all wooden surfaces exposed on the interior side of the wall wherein it is mounted so that they can be finished as desired, but with all surfaces which are exposed to the weather clad in weather-impervious plastic. The invention is equally applicable to casement windows and windows wherein the sash is permanently fixed in the frame, and also to multiple windows, since the invention makes special provision for mounting mullion pieces in cooperative relation with the plastic shell components of adjacent window frames.

DESCRIPTION OF THE PREFERRED EMBODIMENTS

Figure 2:
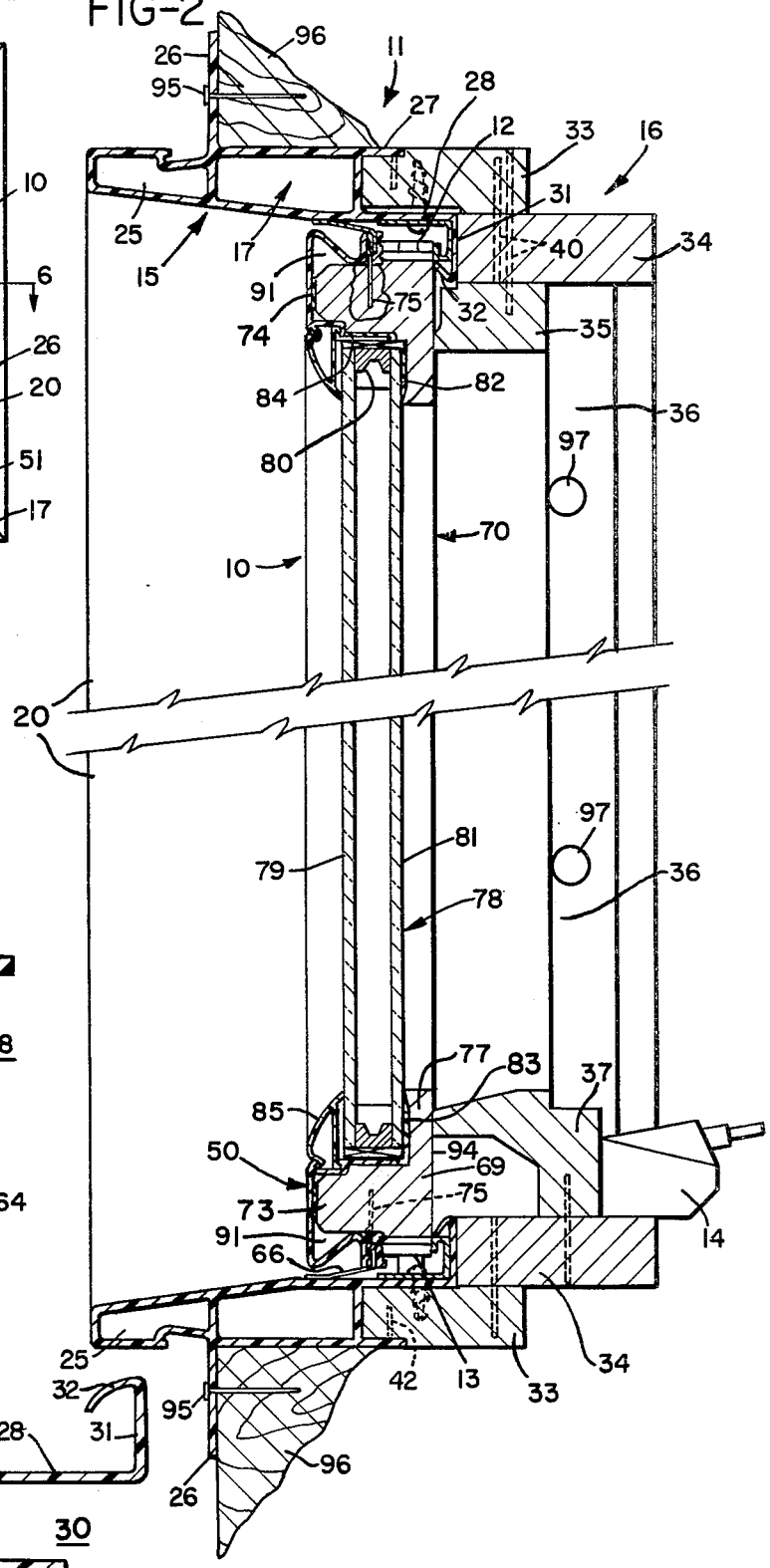
FIG. 2 is a partial vertical section taken on the line 2—2 of FIG. 1 but on a larger scale.
Figure 3:
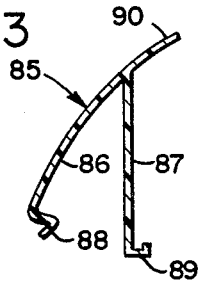
FIG. 3 is a detail view in further enlarged section of the extruded plastic glazing stop incorporated in the sash subassembly in FIG. 2.

Referring to FIG. 2, the sash 10 is mounted in a frame 11 to form the complete window assembly. The particular window assembly chosen for illustration is a casement window wherein the sash 10 is mounted by conventional top and bottom hinges and mounting links 12 and 13 to swing about a vertical axis in the usual manner between closed and open positions under the control of a conventional operating gear drive unit 14 at the interior of the window.

Figure 1:
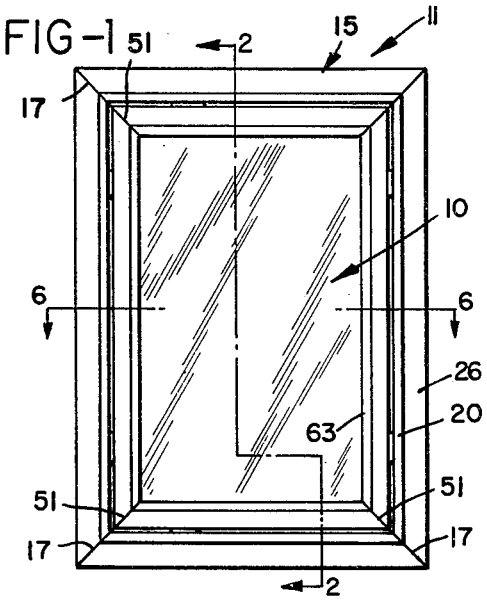
FIG. 1 is a front elevational view showing a casement window assembly embodying the invention.

The frame 11 comprises a composite prefabricated rectangular annular synthetic plastic shell 15 and a rectangular wood frame 16. In the practice of the invention, the frame member or shell 15 is prefabricated before the wooden frame elements are attached. Separate top, bottom and side elements are cut to length from suitably stiff shape-retaining extruded synthetic plastic, such as polyvinyl chloride, with inwardly converging 45° miter ends, which are then welded together under heat and pressure, as indicated at 17 in FIG. 1, to form the unitary substantially integral rectangular frame member 15.

Preferred results have been obtained forming the shell 15 of the polyvinyl chloride sold commercially as Geon 7082-138.

Shell member 15 comprises a hollow nose portion 20 which projects outwardly with respect to the building wall wherein the window is mounted, internal webs 21 and 22 dividing the interior of the united into two cavities 24 and 25, a continuous peripheral nailing flange 26 which extends around the outer side of the frame, and parallel continuous flanges 27 and 28 defining a continuous channel 30 which opens toward the interior of the building. The peripherally inner flange 28 is longer than flange 27 and is inturned at its inner edge to define a further rectangular flange 31 terminating along its inner edge in a continuous sealing lip 32, which is preferably integral with the frame member but of a more flexible consistency enabling it to act as a weather strip for sealingly contacting the inside surface of the sash in windowclosed position.

Thus shell member 15 comprises a continuous annular rectangular hollow shell having a continuous peripheral mounting flange 26 around its outer periphery, a continuous rearwardly inwardly open channel 30 along its inner edge, and a continuous outwardly facing sealing lip 32 around its inner periphery. Flange 26 is parallel to lip mounting flange 31, and they extend in peripherally opposite directions.

The rectangular wooden frame 16 comprises top, bottom and opposite side jamb elements each composed of a pair of wood pieces 33 and 34 of rectangular section which are cut to lengths providing lap corner joints whereby they may be joined and nailed together. Stops 35, 36 and 37 of appropriate section are secured to the inner jamp pieces 34, the side stops 36 being of the same cross section shown in FIG. 6, and the bottom stop 37 being of the conventionally appropriate section to serve as a sill, as shown, for mounting and covering the window-operating hardware. Preferably the side jamb pieces 33 and 34 are overlapped by the top and bottom pieces to maintain the vertical dimension of the frame, but the top and bottom stops 35 and 37 are overlapped by the side stops 36 to maintain the horizontal dimension of the frame.

Figure 6:
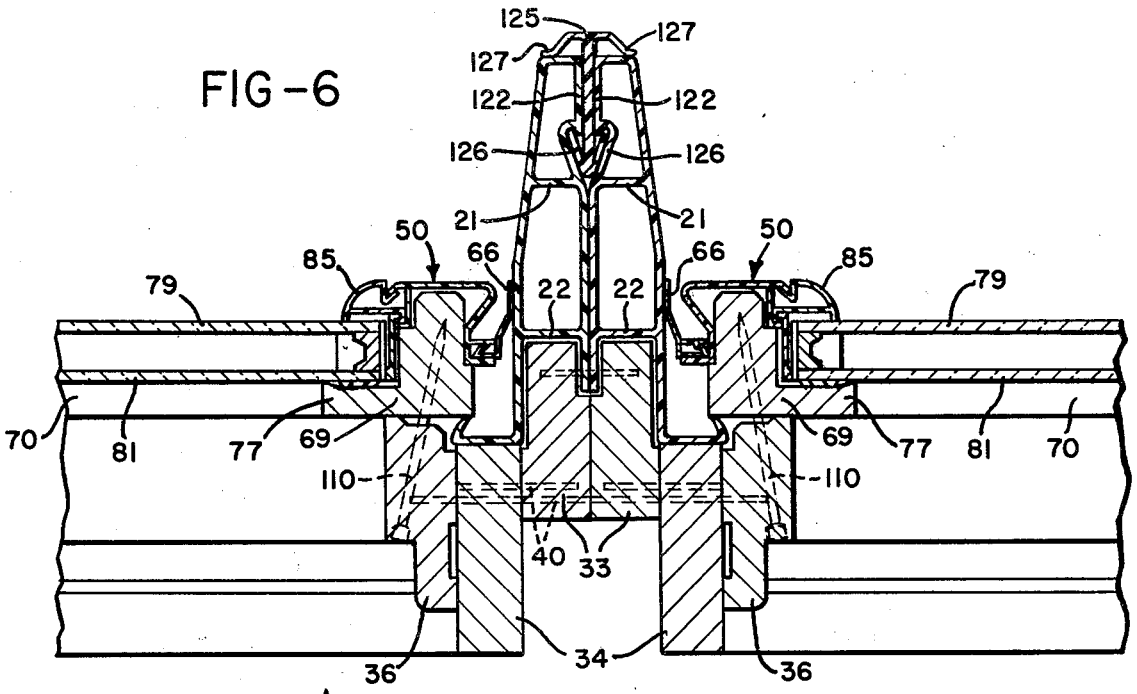
FIG. 6 is a fragmentary view in horizontal section through the adjacent sides of a pair of window assemblies of the invention mounted in juxtaposed side by side relation in a common opening in a wall, the window assembly in FIG. 6 incorporating modifications of the structure shown in FIG. 2.

In practice, the jamb and stop pieces for each frame element are preassembled, as by nailing or otherwise fastening them together as shown at 40 in FIGS. 2 and 6. Then each of the resulting composite sections is mounted in the already fabricated plastic shell 15, by sliding the peripherally outer jamb pieces 33 into the proper section of channel 30, both surfaces of the exposed edge of each piece 33 preferably being rabbeted as shown to provide an easy fit between the plastic flanges 27 and 28.

Before each wood piece 33 enters its channel 30, a layer of sticky mastic or the like (not shown) is deposited all along the bottom of the channel, and as the wood piece 33 is pushed toward the bottom of the channel, it spreads the mastic and causes it to flow up the inner surfaces of flanges 27 and 28, so that in addition to an adhesive bond, a very efficient U-shaped watertight seal is formed between members 15 and 33 which fills at least most of whatever space remains between the flanges 28–29 and the rabbeted portions of jamp pieces 33.

The shell members 15 and frame 16 are thus held together by the fit of the jamb pieces 33 in channels 30, the bond provided by the mastic seal, and usually a series of staples or other fasteners 42 attaching the plastic shell to the jamb parts 33. In addition, the overlapping ends of the jamb elements are stapled or nailed together inwardly of the plastic shell flange 27, as already noted.

Thus the frame subassembly 11 comprises the prefabricated rectangular plastic shell member 15 having a continuous open channel wherein the wooden jamb elements are mounted to construct the wooden frame 16. While each of the wooden frame components is described as made up of three separate pieces secured together, the invention contemplates fabricating the jamb sections from integral milled lengths of wood, but this would be substantially more expensive.

Figure 4:
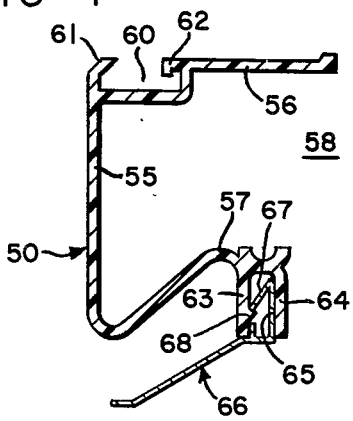
FIG. 4 is a detail view in enlarged section of the extruded plastic sash shell together with its associated weather strip.

The sash 10 is also separately constructed as a subassembly before assembly with frame 11 to provide the complete window. Sash 10 comprises a prefabricated hollow rectangular plastic shell 50, each side of which is a length of extruded synthetic plastic of generally C-shaped cross section as shown in FIG. 4, and is preferably made of the same synthetic plastic as frame member 15. The four sections (top, bottom and sides) of shell 50 are preferably and advantageously cut to length with inwardly converging 45° miter ends which are welded together under heat and pressure to form a unitary integral annular rectangular plastic construction, the 45° miter joints at the sash corners being indicated at 51 in FIG. 1.

Referring to FIG. 4, the sash shell 50 in cross section comprises an outer wall 55 and two inwardly extending side walls 56 and 57 defining a continuous channel 58 which opens toward the interior of the building. Wall 56 is generally perpendicular to wall 55 and is formed adjacent the front of the sash with a continuous groove 60 which is open peripherally inwardly of the sash and is provided along its outer end with opposed lips 61 and 62. As will appear, this groove 60 mounts a substantially continuous finishing glazing strip 85 in the completed assembly.

Wall 57 of shell 50 includes an outer portion which inclines toward wall 56 from the outer end of wall 55, and an inner portion which is generally parallel with the wall 56. A pair of spaced flanges 63 and 64 extend outwardly from the inner edge of wall 57 to define a slot 65. In the window assembly, a weather strip 66 of flexible plastic material is mounted in this slot 65 as shown in FIG. 4, the weather strip 66 having a springy flange 67 along its inner edge which locks behind a shoulder 68 on the flange 63 within the slot 65. When the sash is in closed position, the skirt portion of the weather strip 66 bears on the adjacent inner peripheral surface area of plastic shell member 15, as shown in FIG. 2.

Like frame member 15, the plastic sash member 50 is prefabricated as a unit from four separate side pieces. Then the wooden sash member 70 is constructed by assembly with the prefabricated unit 50 similarly to the frame construction.

Wooden sash member 70 comprises parallel top, bottom and opposite side pieces, all of which are preferably of the same cross section milled to that shape. These pieces are preferably cut to length with ship lap joint ends interfitting in the plane of the sash so that when they are placed in their respective positions within channel 58, their overlapping ends can be nailed together from their exposed surfaces which face inwardly of the room in the mounted portion of the sash.

Each of the four wooden parts of the sash is of generally L-shape in section to provide a nose portion 74 adapted to slide snugly between the parallel portions of wlls 56 and 57. A layer 74 of sticky mastic is preferably placed on the inner surface of shell 50 which contacts nose portion 73 so that it is deformed and distributed to form a conforming seal when each wooden piece is set in place in shell 50.

Preferably, after each wood piece is set firmly in place, it is positively fixed to the plastic shell 50 by a series of staples or like fastening elements 75 (FIG. 2) introduced through the open end of weather strip receiving slot 65. The adjacent interfitting ends of the wood pieces at each corner may be glued together, as well as nailed.

Each of the wood sash pieces includes a flange 77 projecting inwardly to define with the adjacent surface of the plastic shell wall 56 a pair of glass panel seating surfaces disposed at right angles to each other, the seat side of the nose portion 73 being covered by the plastic wall 56. The dual glass unit 78 is of a conventional type comprising two rectangular panels 79 and 81 of glass spaced and mounted in a spacer rim 80.

A layer of strongly adhesive sealing material, preferably in tape form as shown at 82, is laid in a continuous rectangle on flanges 77, which are grooved at 83 to retain the material 82, and the glass unit is centered by means of conventional setting blocks 84 and pressed tightly against this adhesive layer 82. Vacuum may be applied to the glass unit to press the glass unit toward flanges 77 while the plastic-wood assembly is held stationary in a suitable jig for a sufficient time to allow the adhesive to set and ensure a good tight bond.

After the glass unit 78 is fixed in place, the sash is completed by mounting glazing strip sections 85 in the channels 60 in plastic shell 50. Preferably these strips are of extruded resilient plastic with a pleasingly curved and relatively bendable outer wall 86 and an inner wall 87 formed along their free edges with hook-like flanges 88 and 89 which latch under lips 61 and 62 at the mouth of groove 60. Also, the free edge portions 90 of the strip 85 which bear on the glass panel are preferably more flexible and resilient than the remainder of the strip to establish a good sealing fit against the glass.

The sash 10 and the frame 11 are now complete separate subassemblies, except for installation of the supporting, actuating and latching hardward, which are conventional. FIG. 2 shows the window assembly mounted in a building opening and the sash in closed position in the frame. The flat wooden sash surfaces exposed to the interior of the building bear all around on the flexed resilient seal lip 32 of the frame, which is located between the stops 35–37 and the periphery of the sash and thus seals the wooden parts of the frame from the outside weather and excess inward displacement is controlled by the stops 35–37. With the sash closed, weather strip 66 also becomes effective, so that dual peripheral seals are provided. It will be noted that the exposed wooden sash surface may be painted, stained or similarly decorated, while all areas of the wooden parts outside the building are covered by plastic and sealed.

It is essential to the method of the invention that the shell members 15 and 50 be shaped to receive their complementary wood pieces directly, by movement of the wood pieces in a sidewise direction between the plastic walls which engage the inner and outer surfaces of the wood pieces in the finished structures. This is readily accomplished in the frame assembly by means of the parallel flanges 27 and 28.

In the sash assembly, the portions of the walls 56 and 57 which engage their associated wooden element are also substantially parallel as shown, but the inclined portion of the wall 57 which diverges from the associated wooden piece cooperates with the adjacent portion of the front wall 55 to define an open space 91 within the shell while providing the sash with the appearance of being substantially wider than the wooden element itself. Also, as shown in FIG. 2, this portion of the shell shields the mounting of the weather strip 66 from view as well as from the elements.

The window assembly comprising the sash 10 mounted in operative relation in the frame 11 may be secured in a building opening and attached thereto by nails 95 or like fasteners passing through plastic flange 26 into studs or the like 96. So installed, the window presents only plastic surface exteriorly to resist the action of water and sun while at the same time providing for painting or other finishing of the wooden frame and sash parts exposed to the interior of the building. Where desired, holes such as indicated at 97 are formed in the side stops 36 for mounting an internal screen assembly.

Figure 7:
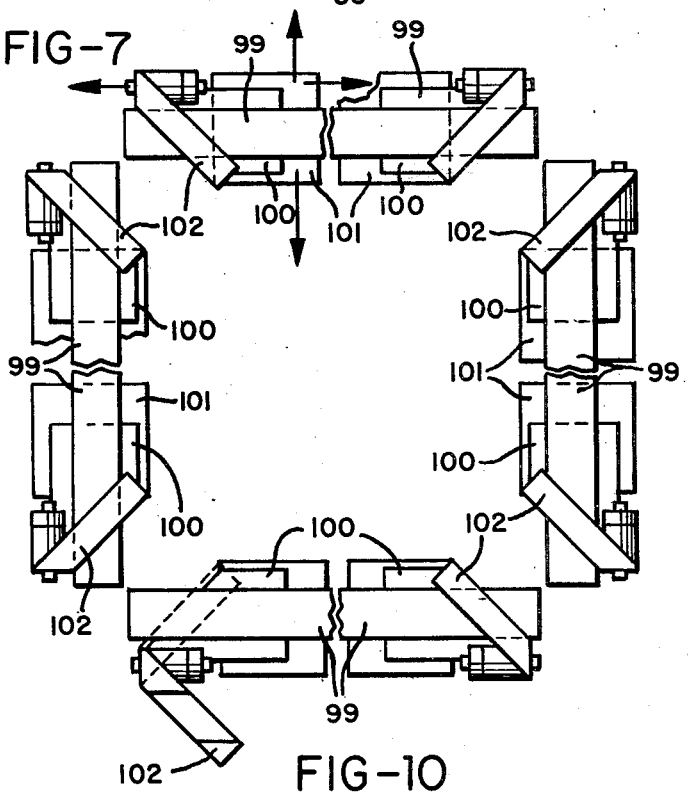
FIGS. 7–10 are diagrammatic views ilustrating successive stages in the method of the invention by which the plastic shell components of the frame and sash subassemblies are constructed from four separate lengths of extruded plastic material.
Figure 10:
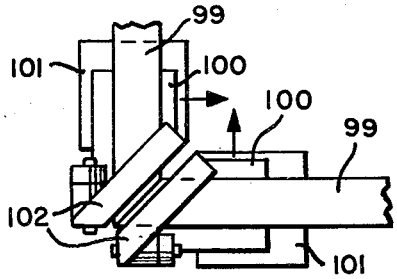

The novel method of the invention by which the plastic frame shell 15 is assembled is shown in FIGS. 7 and 10, and the same steps are followed in assembly of the sash.

Referring to FIG. 7, each of the four pieces 99 of extruded plastic which are to form the four sides of the shell 15 is mounted with its flange portion 31 uppermost and innermost on one of four pairs of jigs 100 which generally define the sides of a rectangle. Each pair of jigs is mounted on its own carriage 101 which is supported for controlled back and forth movement in a horizontal plane transversely of the length of the plastic piece, and the jigs are also relatively adjustable on the carriage in accordance with the length of the plastic piece. At this stage, each plastic piece has its ends square cut to a length slightly greater than its maximum finished outer length, e.g., by approximately an inch to minimize waste.

Figure 5:
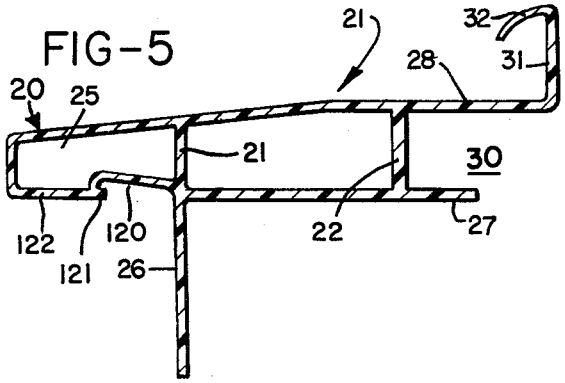
FIG. 5 is a view similar to FIGS. 3 and 4 showing the extruded plastic shell component of the frame subassembly.

Each jig 100 has a working surface complementary to the surface areas of the shell to the left of flanges 26 and 31 in FIG. 5 and forms the bottom part of a two-part clamp, the upper part 102 of which is mounted to move into and out of clamping engagement with, its mating jig 100 and has its working surface closely approximating the outer contour of the plastic piece exposed by the jig 100. The side of each clamp part 102 and jig 100 adjacent the end of the piece 99 extends at 45° to the length of the piece, and for each size of frame, each pair of jig-clamps is adjusted to a spacing wherein their 45° faces are separated by a total distance of approximately ¼ inch less than the desired finished dimension of the plastic piece.

Figure 8:
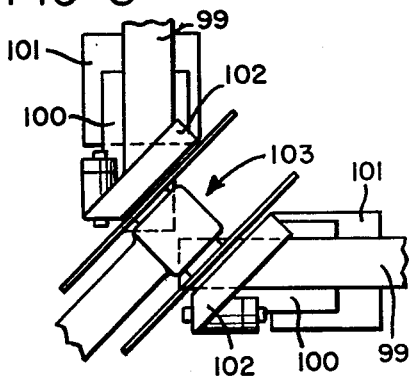

After each plastic piece has been clamped as described, a saw 103 (FIG. 8) associated with each jig-clamp cuts off the exposed end of the piece at 45°, the spacing of the saw blade from the associated jig-clamp preferably being such as to leave only approximately ⅛ inch of the plastic piece projecting beyond the 45° faces of the jig-clamp. This cutting operation is advantageously performed by a pair of saws 103 on a common shaft for simultaneously cutting the adjacent ends of two plastic pieces.

Figure 9:
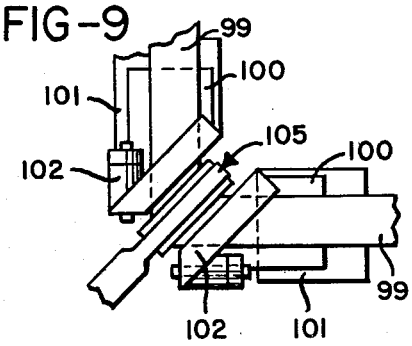

After all of the plastic pieces have been trimmed in this manner, a heating plate 105 (FIG. 9) of rectangular shape is moved into position between each of the pairs of opposed miter-cut ends of the plastic pieces, and the four carriages 101 move the jig-clamps towards each other to bring the cut ends of the plastic pieces into engagement with the heating plate. Sufficient softening and/or melting of the plastic requires only a few seconds, during which the carriages continue to be urged towards each other to maintain the engagement of the plastic with the heating plates.

The carriages are then retracted momentarily, for an interval just long enough to withdraw the heating plates, and then are immediately again moved towards each other to bring the miter-cut ends of the plastic pieces into firm pressure engagement with each other while they are still sufficiently soft and tacky to adhere to each other, as shown in FIG. 10. During this latter operation, the carriages 101 continue to move toward each other until they reach preset positions wherein the relative spacings of the opposed jig clamps are such that each side of the rectangular plastic shell is of the desired predetermined length, and all parts then remain stationary for the few seconds required for setting of the softened plastic. The clamps can then be opened, and the shell element can be removed and is ready for addition of its complementary wooden frame, no other finishing being needed except occasional trimming of excess flash along the one or more of the welded corners.

The same sequence of steps is followed in fabricating the sash shellls 50, in which the initially separate strips of extruded plastic are similarly mounted on jigs with their front walls 55 uppermost and then similarly clamped for the subsequent sawing, melting and joining steps. The arrangement of jig-clamps and carriages can be the same as described for the frame shells, except for the design of the working faces of the jig-clamps to match the outline of the sash shell plastic pieces.

In addition to its convenience, the method of the invention offers the important advantages that the plastic strips are trimmed with assured accuracy to the proper miter-cut lengths and held in fixed parallel, perpendicular and aligned relation with each other until their ends are welded together in the resulting accurate rectangular shape and dimensions.

It would be thought that welding of such relatively complex sections of comparatively thin plastic, e.g. 0.040 inch in thickness, would be difficult. However, the method of the invention as described, including particularly the accurate alignment of the miter-cut ends with only a fraction of an inch projecting from each of a pair of cooperating clamps, has been found to produce strong and accurately welded corners with high consistency at high production rates.

The subsequent steps of the method wherein the wooden frame or sash parts are assembled and secured to the plastic shells further promote the economical production of accurately dimensioned window assemblies offering in use the advantages outlined above. Thus while the individual wood jamb and sash parts could be assembled into complete rectangular frames before being combined with their complementary plastic shells, this would require additional equipment for their automatic assembly, and the resulting wood frames would require far greater space for temporary storage than the separate lengths of wood stock. Further the separate wood frames would have much less inherent strength and rigidity than when they are combined with their plastic shells, and would present possibilities of damage which are obviated by the method of the invention.

FIG. 6 illustrates the application of the invention to a fixed (non-operable) window, and also to the assembly of a plurality of the windows of the invention in a common wall opening. Referring first to the fixed window application, all of the frame and sash parts are the same as described in connection with FIGS. 1–5, and FIG. 6 also illustrates in section the stops 36 used on each side of the window of FIG. 2.

When the invention is applied to a fixed window, the same stock is used for the stops on all four sides of the window, namely the stock shown for the stop 36 in FIG. 6. No mounting hardware for the sash is needed, but the sash is simply set in position and secured to the frame by finishing nails 110 driven as shown through the stops 36 into the sash member 70, the number and location of these nails being variable to suit the dimensions of the window.

When it is desired to use a plurality of the windows of the invention in a common wall opening, the only modification required is to trim off the flanges 26 along the sides of the frames which are to be set in side by side relation. As shown in FIG. 6, it is then possible to set the frames with the adjacent jamb parts 33 and shell walls 27 in abutting relation.

When the frames are used in this manner, use is made of the grooves 120 in the outer sides of the nose portions 20 of the plastic shells 15. As best seen in FIG. 5, the groove 120 terminates in a hook-like rim 121, and the adjacent portion 122 of the wall of the nose portion 20 is offset laterally with respect to the wall 27 by an amount slightly less than the thickness of the wall itself. The result of this configuration is that when two frames are arranged in abutting relation as shown in FIG. 6, there is a clearance between the opposed wall portions 122, and this clearance is filled by the mullion cover 125 shown in detail in FIG. 7.

The part 125 has an arrowhead configuration in section at its inner edge which provides a pair of flanges 126 proportioned to fit in the grooves 120 and catch under the groove rims 121 as shown in FIG. 6. The outer edge of the part 125 is generally T-shaped in section, providing a pair of laterally extending flanges 127 proportioned to overlie the nose portions 20 of adjacent frames.

Preferably, the outer marginal portions of the flanges 127 are of a greater flexibility than the remainder of the part 125, and the part as a whole is so proportioned that with its flange portions 126 anchored in the grooves 120, the flanges 127 will overlie and press against the nose portions 20 to form an effective seal between the adjacent shell members 15. Preferably, the part 125 is formed by extrusion from the same synthetic plastic as the frame and sash shells 15 and 50, with the flexible portions of the flanges 127 being simultaneously extended by of a suitably flexible plastic, e.g. Geon 83741-132. The part 125 can be set in place by simply inserting its arrow-shaped edge in the slot between adjacent nose portions 20 and then pressing it inwardly of the slot until its flanges 126 enter and lock in the opposed grooves 120.

While the articles and methods herein described constitute preferred embodiments of the invention, it is to be understood that the invention is not limited to these precise articles and methods, and that changes may be made therein without departing from the scope of the invention.

What is claimed is:

1. A composite window frame subassembly for supporting a sash in a building opening comprising (a) a prefabricated unitary rectangular annular synthetic plastic shell having substantially the same cross section on all sides and including substantially parallel rearwardly extending flange portions defining a continuous rearwardly open channel, (b) said plastic shell comprising top, bottom and side portions having miter joints welded together at all corners thereof to form an integral four-sided unit independently of the remainder of said assembly, (c) a wooden frame complementary in shape and dimensions to said shell and including a forward portion received with said channel in secured relation with said shell and a rearward portion extending beyond said shell, whereby when said subassembly is installed in a wall, the outer side thereof is clad with protective plastic while the inner side presents substantially only wooden surfaces for finishing, (d) said frame forward portion being proportioned to be received within said shell channel by direct relative movement of said frame and shell toward each other, (e) said plastic shell including wall and web portions defining a structure of closed hollow cross section including a nose portion proportioned to project forwardly of a wall wherein said frame is mounted and flange portions projecting in spaced parallel relation from said hollow section to define said channel, (f) said wooden frame including jamb elements secured together at the corners of said subassembly including a forward edge portion received within said channel, and (g) the peripherally inner of said flange portions including a further flange portion extending at right angles thereto and having an integral flexible lip portion extending therefrom in inwardly overlying relation with said inner flange portion in position for sealing engagement by the associated sash.

2. A composite window subassembly as defined in claim 1, wherein each of said jamb elements has a stepped configuration section providing a peripherally outer portion proportioned to be received within said channel and a peripherally inner portion defining a shoulder abutting said further flange portion.

3. A composite window subassembly as defined in claim 1, further comprising stop elements secured to the peripherally inner surfaces of said jamb elements peripherally inwardly of said flexible lip portion, whereby said lip portion forms a seal with the associated sash between said stop elements and the outer periphery of the sash.

4. A composite window sash subassembly for mounting a glass panel in a window frame, comprising (a) a prefabricated unitary rectangular annular synthetic plastic shell having substantially the same cross section on all sides and including substantially parallel rearwardly extending flange portions defining a continuous rearwardly open channel, (b) said plastic shell comprising top, bottom and side portions having miter joints welded together at all corners thereof to form an integral four-sided unit independently of the remainder of said assembly, (c) a wooden frame complementary in shape and dimensions to said shell and including a forward portion received within said channel in secured relation with said shell and a rearward portion extending beyond said shell, whereby when said subassembly is installed in a wall, the outer side thereof is clad with protective plastic while the inner side presents substantially only wooden surfaces for finishing, (d) said frame forward portion being proportioned to be received within said shell channel by direct relative movement of said frame and shell toward each other, (e) said plastic member including a front wall and peripherally inner and outer rearwardly extending walls defining said channel, (f) said wooden elements being of generally L-shape in section providing a nose portion received in said channel and a peripherally inwardly extending flange portion defining with said nose portion a right angled seat for a glass panel, and (g) said inner plastic wall overlying the side of said seat on said nose portion.

5. A composite window subassembly as defined in claim 4 further comprising a glass panel received on said seat, adhesive means bonding said glass panel to the side of said seat on said flange portion, and glazing strip means mounted on said plastic member and engaging the outside of said glass panel.

6. A composite window subassembly as defined in claim 4 wherein said outer plastic wall includes a pair of flange portions defining a peripherally outwardly opening slot, and further comprising a weather seal strip including a mounting portion received in said slot and a flexible skirt portion positioned for sealing engagement with the surrounding portion of the window frame wherein said sash is mounted.

7. A method of manufacturing a rectangular annular synthetic plastic shell for a window subassembly which comprises the steps of (a) providing four side elements of extruded plastic having the same cross section, (b) first gripping in accurate parallel and perpendicular relation opposed pairs of said plastic elements of greater length than desired in the finished shell, (c) miter cutting the ends of said elements to accurately predetermined lengths with the ends of opposed said elements accurately aligned with each other, (d) inserting heating plate means between adjacent said cut ends of said elements, (e) urging said elements towards each other into melting engagement with said heating plate means until said cut ends are substantially softened, (f) retracting said elements, (g) withdrawing said heating plate means, and (h) then immediately again advancing said elements towards each other into maintained pressure engagement of their adjacent softened ends until the softened material thereof has welded together to form the unitary rectangular shell.

8. The method defined in claim 7 wherein said last named step is continued only until said elements have reached relative positions wherein they accurately define predetermined dimensions for said plastic shell.

9. The method defined in claim 8 wherein said plastic elements are configured in section to provide a continuous open rectangular channel in said unitary shell, and further comprising the steps of inserting wooden elements in each side of said channel, securing each said element to said shell, and fastening the adjacent ends of said wooden elements together to form a rectangular wooden frame secured to said plastic shell.

10. The combination of a pair of window frames mounted in side by side relation in a wall opening and each comprising (a) a prefabricated unitary rectangular annular synthetic plastic shell having substantially the same cross section on all sides and including substantially parallel rearwardly extending flange portions defining a continuous rearwardly open channel, (b) said plastic shell comprising top, bottom and side portions having miter joints welded together at all corners thereof to form an integral four-sided unit independently of the remainder of said assembly, (c) a wooden frame complementary in shape and dimensions to said shell and including a forward portion received within said channel in secured relation with said shell and a rearward portion extending beyond said shell, whereby when said subassembly is installed in a wall, the outer side thereof is clad with protective plastic while the inner side presents substantially only wooden surfaces for finishing, (d) said frame forward portion being proportioned to be received within said shell channel by direct relative movement of said frame and shell toward each other, (e) said plastic shell including wall and web portions defining a structure of closed hollow cross section including a nose portion proportioned to project forwardly of a wall wherein said frame is mounted and flange portions projecting in spaced parallel relation from said hollow section to define said channel, (f) said wooden frame including jamb elements secured together at the corners of said subassembly including a forward edge portion received within said channel, and (g) said frames being mounted with the adjacent said shells in closely adjacent relation, (h) each of said nose portions of said shells having a recess in the outer side thereof, (i) the outer edge of said recess including an inwardly facing hook portion, and (j) a synthetic plastic mullion cover inserted between said adjacent nose portions, (k) said mullion cover including a pair of outwardly facing flanges proportioned to fit within said recesses in locked relation with said hook portions and a pair of outer flange portions proportioned to overlie the outer edges of said nose portions of said adjacent sides of said shells.

11. The combination defined in claim 10 wherein the peripherally outer wall of each said nose portion is offset inwardly with respect to the peripherally outer of said channel-defining flanges thereon to provide space between said walls for said mullion cover when said outer flanges on said pair of frames are in abutting relation.

12. A window assembly adapted for mounting in an opening in a building wall and comprising a frame subassembly and sash subassembly having the following charactertistics:

(a) said frame subassembly comprising a prefabricated unitary rectangular annular synthetic plastic shell having substantially the same cross section on all sides and including substantially parallel rearwardly extending flange portions defining a continuous channel open toward the interior of the wall wherein said subassembly is mounted, (b) said plastic shell comprising top, bottom and side portions having miter joints welded together at all corners thereof to form an integral four-sided unit independently of the remainder of said assembly, (c) the peripherally inner of said flange portions including a further flange portion extending at right angles thereto peripherally inward of said subassembly and having an integral flexible lip portion extending therefrom in overlying relation with said inner flange portion for sealing engagement by the sash assembly, (d) a wooden frame complementary in shape to said shell and including a forward portion received within said channel in secured relation with said shell and a rearward portion adapted to be exposed on the interior side of the wall wherein said subassembly is mounted, (e) said frame forward portion being proportioned to be received within said shell channel by direct relative movement of said frame and shell toward each other, (f) said sash subassembly also comprising a plastic shell including top, bottom and side rearwardly extending flange portions defining a continuous rearwardly open channel and having miter joints at all corners thereof welded together to form an integral four-sided unit independently of the remainder of said subassembly, (g) a wooden frame complementary in shape to said sash shell and of generally L-shape in section providing a forward nose portion received in said sash shell channel and a rearward portion adapted to be exposed on the interior of the wall wherein said window assembly is mounted and including a peripherally inwardly extending flange portion defining with said nose portion a right angled seat for a glass panel, (h) said sash frame nose portion being proportioned to be received within said sash shell channel by direct relative movement of said frame and shell toward each other, and (i) a glass panel received on said seat in adhesively bonded relation therewith.

* * * * *